United States Patent [19]

Heyn

[11] 4,440,310

[45] Apr. 3, 1984

[54] CLOSURE FOR DOMED BEVERAGE CONTAINERS AND THE LIKE

[75] Inventor: William M. Heyn, New Canaan, Conn.

[73] Assignee: The Continental Group, Inc., Stamford, Conn.

[21] Appl. No.: 463,230

[22] Filed: Feb. 2, 1983

[51] Int. Cl.[3] ..... B65D 17/34

[52] U.S. Cl. ..... 220/270; 220/307; 220/258

[58] Field of Search ..... 220/260, 270, 307, 258; 215/237

[56] References Cited

U.S. PATENT DOCUMENTS

| | | | |
|---|---|---|---|
| 4,344,545 | 8/1982 | Aschberger et al. | 220/270 |
| 4,350,261 | 9/1982 | Roth | 220/270 |
| 4,369,888 | 1/1983 | Walter | 220/307 |

*Primary Examiner*—George T. Hall

*Attorney, Agent, or Firm*—Charles E. Brown

[57] ABSTRACT

A closure for a container in which a plastic closure part is tightly fitted into the container neck and a tab-operable disk in which the tab is releasably interlocked with the plastic part. The disk may also be directly mounted within an end portion of a container body and the container body may be provided with a replaceable overcap.

16 Claims, 15 Drawing Figures

CLOSURE FOR DOMED BEVERAGE CONTAINERS AND THE LIKE

This invention pertains to a closure which comprises a plastic portion telescoped within the mouth of a container and wherein a disk is peripherally secured within the plastic portion and has a continuous score which is adapted to be broken by use of a tab secured to the disk.

A general object of the invention is to provide a novel closure which is simple to fabricate and to apply to a container.

A further object is to provide a novel closure in which an openable disk which in one form is snap-fitted into an internal groove in a plastic neck portion of a container element and in another form is laid against a shoulder within a neck bore and secured by adhesive. In still another form of the invention the disk is molded into the neck bore periphery, and in a further form the neck has a shoulder against which a side of the disk is laid and there is a ring which can be sonically welded over the opposite side of the disk along the edge thereof.

A general object of the invention is to provide several novel methods of assembling the plastic neck portion of a container with a scored easy-opening closure disk.

One specific example of the invention is a novel closure for a thin metal container comprising an upwardly flaring neck, the closure comprising a plastic tubular section insertable into the neck and having a cylindrical bore and an upwardly flaring outer surface which complimentally seats against a frustoconical surface of the neck, the plastic section becoming thicker toward the top for reducing the flexibility thereof adjacent to its area of securement to the metal closure disk.

Another example of the invention may be the usage of the closure in conjunction with a plastic container where the periphery of the closure may be bonded to the mouth portion of the container such as by heat sealing.

The closure may also have a different locking arrangement from that set forth above for interlocking with other types of containers which may be metal or plastic.

Further, the container per se, particularly a plastic container, may have incorporated in the mouth thereof a closure per se, a disk with a weakening line formed therein and including an opening tab. Such a closed container may then be provided with a protective overcap.

These and other objects inherent in and encompassed by the invention will become more apparent from the specification and drawings wherein.

Figure 1:
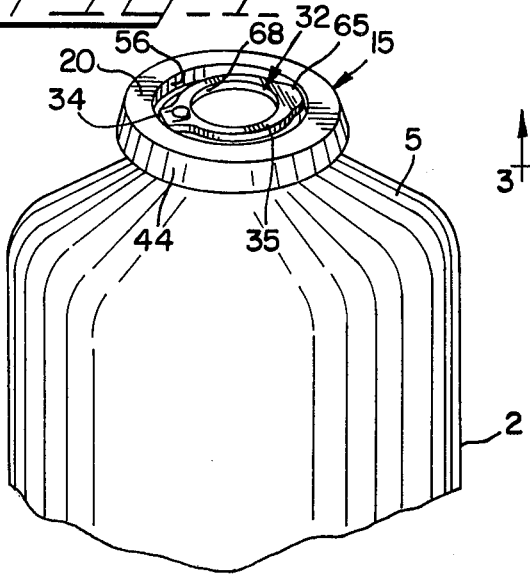
FIG. 1 is a fragmentary perspective view of a container incorporating my novel closure.

Referring to the drawings, there is shown in FIG. 1 a metal container 2 having a body portion 3 with a closed bottom (not shown) and a dome 5 at its upper end terminating in a small diameter integral neck 7.

The neck 7 has at its lower end an out-turned flange 8 which is integrally formed about its outer periphery with the narrow end of the dome. The inner periphery of the flange 8 merges into the lower end 10 of the neck at an acute included angle therewith. The neck 7 has a frustoconical bore 11 and diverges upwardly and at its upper edge is provided with an out-turned curl 12 of circular cross section.

A plastic closure 15 made of polymeric resins such as polyethylene, polypropylene and the like is inserted into the neck and comprises a tubular portion 16 which has a cylindrical bore 17 and a frustoconical outer surface 18 in complementary fit within the interior of a similar surface 11 of the neck 7. The plastic of the portion 16 thus becomes radially thicker as it approaches the top end of the neck to obtain a rigid section where it merges with the bottom side of a top wall or ring of the closure. Within the ring 20 there is formed an internal radial groove 22 which at its lower side is defined by a ring flange 24 extending radially inwardly of a flange portion 25 of the ring 20 defining the upper side of the groove 22.

The groove 22 receives a peripheral edge 26 of a closure disk 27 made of sheet metal such as aluminum. The disk is provided with an annular weakening line in the form of a score 28. A rivet 29 extends through an aperture 30 of an opener or tab 32 which initially lays flat against the external side 33 of the disk.

The tab has a narrow nose portion 34 which is connected to a ring-like handle portion 35.

An integral bendable lug 36 connects the nose 34 with the rivet and allows the tab to be lifted upwardly and the nose to fulcrum against the outer edge portion 26 of the disk beyond the score and to break the score to form a pour opening 37 within the disk by pulling out the removable section 40 of the disk.

The closure has a top wall 20 extending over a curl 12 of the neck in pressure contact therewith at 42. The top wall has a peripheral skirt portion 44 which overlaps the outer side of the curl. The lower edge 45 of the skirt 44 terminates above the dome portion of the container. The lower end of the tubular portion 16 of the closure has an outwardly extending shoulder 46 which has an upper flat face 48 which snaps under the flange 8 and seats against a face 50 thereof. The shoulder 46 is tapered downwardly on its outer side 52 and is triangular in cross section so as to be easily insertable into the neck bore 11. The shoulder also being flexible because of its triangular section, easily deflects beneath the seat 50.

It will be noted that the disk and tab when unopened lie below the top surface 54 of the top wall of the closure, the tab being located within the opening 56 of the top ring 20. Also the circular score 28 in the disk is of greater diameter than the marginal edge 58 in the ring flange 24 and smaller than the edge of the opening 56 in the ring 20 so that to open the disk the user must not only deflect the edge portion of the disk downwardly, but must also deflect the ring flange 24 downwardly.

FIGS. 5, 6, 7, 7A, 8 and 9 illustrate different assemblies of the disk with the plastic closure.

Figure 5:
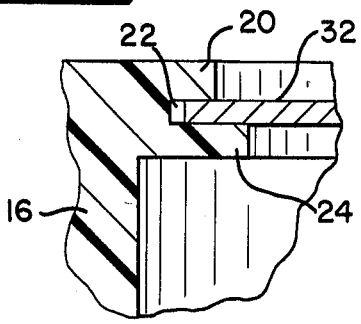
FIGS. 5, 6, 7, 7A, 8 and 9 are fragmentary sectional views showing different ways of securing the disk within the plastic neck insert.

In FIG. 5, the disk is inserted into a mold and the flanges 20–24 molded thereabout.

Figure 6:
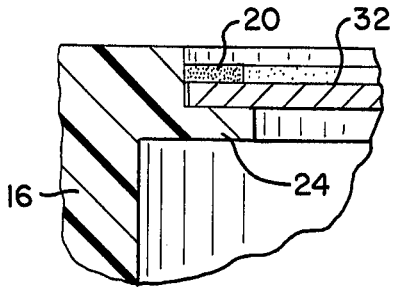

In FIG. 6, the ring 20 is made separate and is spin molded to the disk and tubular portion 16.

Figure 7:
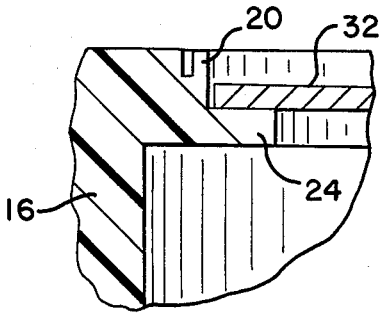
Figure 7A:
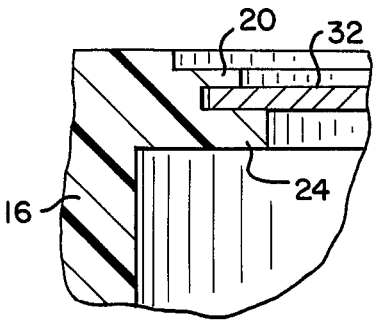

In FIG. 7, the flange 20 initially extends edgewise axially and is folded over the top of the edge of the disk and sonically welded as shown in FIG. 7A.

It is also to be understood that there can be a reversal of the parts 20, 24 from that shown in FIGS. 7, 7A, with the ring 24 being disposed axially outermost. This would permit the folded ring 20 to be urged tightly against the closure disk 32 under internal pressures.

Figure 8:
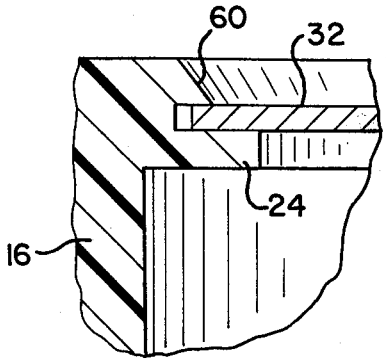

In FIG. 8, the ring portion 20 is tapered toward the center and allows the disk to be snapped into the groove by being axially pressed against the top surface 60 and wedged downwardly.

Figure 9:
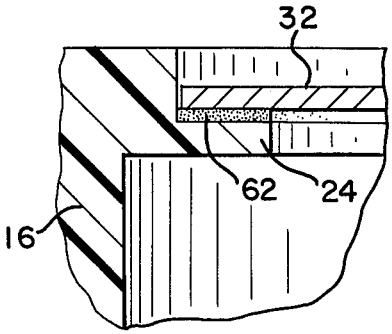

In FIG. 9, the top ring 20 is eliminated and the adhesive 62 is applied to the under edge of the disk and the adhesive contacts the top of the ring 24 and adheres thereto.

Figure 2:
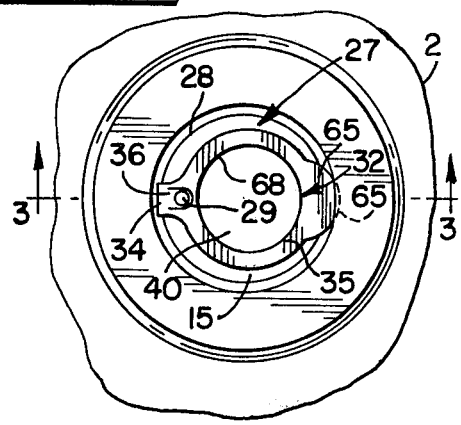
FIG. 2 is a top plan thereof.
Figure 3:
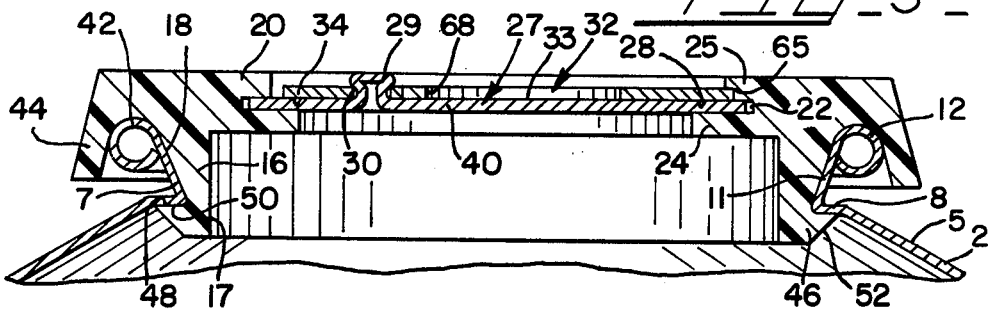
FIG. 3 is an enlarged cross section taken substantially on line 3—3 of FIG. 2.
Figure 4:
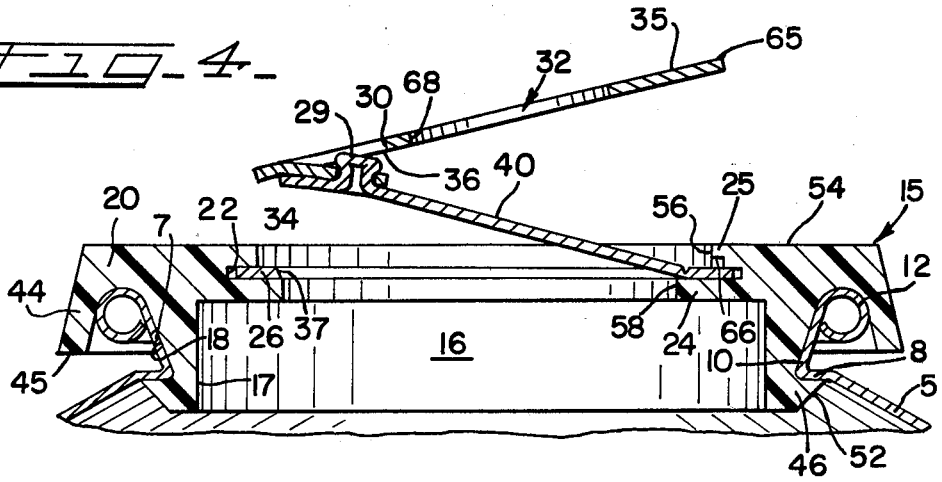
FIG. 4 is a cross section similar to FIG. 3, showing the closure in partially open position.

As best seen in FIGS. 2, 3 and 4, the end portion of the handle of the ring remote from the nose has an extension 65 shaped to fit into a slot 66 in the ring 20. This feature not only holds the tab down, but also provides a secondary interlock of the disk assembly to the plastic part and serves as a backing for the disk against accidental blowout. To open, the user initially puts his finger into the handle aperture 68 and pushes toward the nose to release the latching engagement of the extension 65 with the ring portion 20. Furthermore, by having the tab overlap the score at diametrically opposite sides, any impact against the tab will not break the score.

Figure 10:
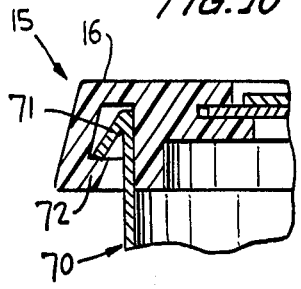
FIG. 10 is an enlarged fragmentary sectional view showing a slight modification of the closure periphery for interlocking with a different container configuration.
Figure 11:
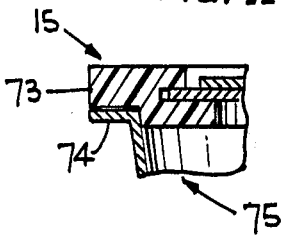
FIG. 11 is a fragmentary sectional view similar to FIG. 10, showing a closure of the type to which this invention relates wherein the periphery of the plastic element is bonded to the container.

Although a preferred interlock between the container neck and the closure 15 has been illustrated, it is to be understood that a wide variation of interlocks is feasible. With reference to FIG. 10, it will be seen that there is illustrated a container 70 having at the outer mouth thereof a radially outwardly and axially downwardly directed flange 71 which is generally hook-shaped. The closure portion 16 may be modified to define a radially inwardly and upwardly directed flange 72 which will interlock beneath the flange 71 to retain the closure 15 in place.

The periphery of the closure 15 may also be modified to define a flat structure or surrounding flange 73 for application to a flange 74 of a container 75. Depending upon the materials of the flanges 73, 74, the flanges may be bonded together in numerous manners including heat sealing, sonic welding and adhesive bonding as well as other similar conventional methods.

It is to be understood that while it is preferred that the closure tubular portion 16 be formed of plastic and that the closure disk 27 be formed of sheet metal such as aluminum, and that the closure be primarily utilized in conjunction with metal containers, the invention is not so limited. While normally the closure portion 16 will be formed of plastic, the closure disk 27 could also be formed of plastic and the container may be formed of either metal or plastic.

Figure 12:
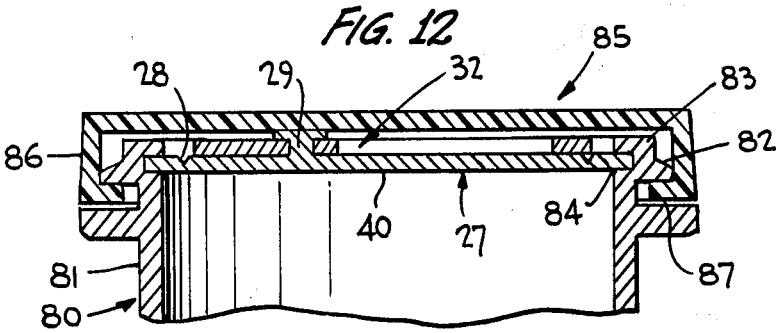
FIG. 12 is a sectional view through the upper portion of another form of container incorporating a closure unit of the general type to which this invention relates.
Figure 13:
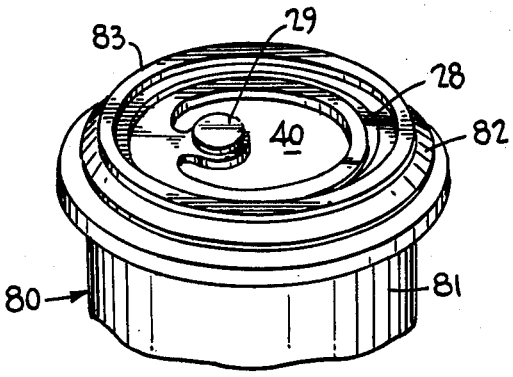
FIG. 13 is a top perspedtive view showing the closed container of FIG. 12 with the overcap thereof removed.
Figure 14:
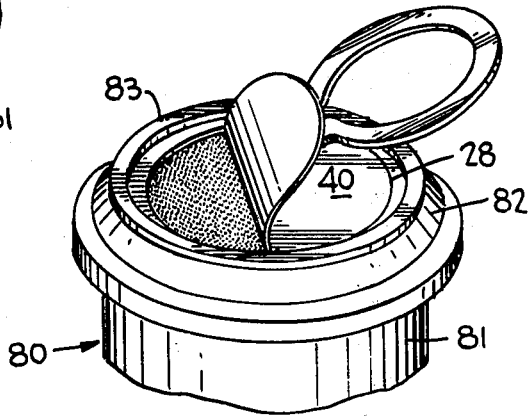
FIG. 14 is a fragmentary top perspective view similar to FIG. 13 showing the container in the process of being opened.

The openable closure disk 27 may also be utilized to directly close a container mouth. Accordingly, attention is directed to FIGS. 12–14 wherein there is illustrated a plastic container 80 having a tubular body 81 which is provided on the outer surface thereof adjacent its free top end with a radially outwardly directed locking flange 82. The locking flange 82 is part of an enlargement 83 which permits the forming of an internal annular groove 84 in which the periphery of the closure disk 27 may be seated. The closure disk 27 will be provided with a continuous weakening line, such as the score 28, to define a removable panel portion 40 and to the removable panel portion 40 there is secured by way of the rivet 29 or a similar rivet an opening tab 32.

While the container 80 is initially closed by the closure disk 27, there is provided an overcap 85 which initially functions as a protective cap for the closure disk 27 and which is utilized after opening of the container to effect the reclosing of the container. The cap 85 has a depending skirt 86 which terminates in a lower radially inwardly directed flange 87 which locks beneath the flange 82. The details of the flanges 82 and 87 may be varied in accordance with customary practice in this field of endeavor.

Having disclosed a preferred embodiment of the invention, it will be apparent that various modifications can be made within the scope of the appended claims.

I claim:

1. In combination, a container having an end portion defining an open end, a plastic fitment, said end portion and said fitment having cooperating means providing sealing attachment of said fitment to said container, said fitment having an opening, a closing disk, means connecting said disk to said fitment whereby said disk closes off the opening, said disk having a weakening line defining an opening panel in said disk, and manually operable tab means cooperating with said disk to break said disk along said weakening line for removal of said opening panel and providing access to contents of said container.

2. The invention according to claim 1 wherein said neck has a frustoconical section and said plastic portion having a similarly shaped portion snugly fitted therein.

3. The invention according to claim 1 wherein said weakening line has an endless contour.

4. The invention according to claim 1 wherein said tab is recessed within the upper end of said bore.

5. The invention according to claim 1 and said means for connecting said disk to said plastic portion comprising a ring flange formed integral with said portion within said bore, said disk having a peripheral edge portion overlying said ring flange and means securing the edge portion to said ring flange.

6. The invention according to claim 5 and an additional ring within said plastic portion within the bore, spaced axially of said ring flange and receiving said edge portion of the disk therebetween and secured thereto.

7. The invention according to claim 6 and said additional ring extending initially edgewise axially of the bore and being flapped over the edge of the disk and secured thereto.

8. The invention according to claim 6 and said additional ring being integral with said plastic portion and defining a disk-receiving groove having a wedging edge accommodating wedging of the edge of the disk through said additional ring into said groove.

9. A closure for a container having a neck defining bore, said closure comprising a plastic tubular insert tightly fitted into said bore and providing a pour opening, means on said tubular insert for securement to a container, a disk extending across said bore and sealed to said tubular insert, a generally circular weakening line in said disk defining a separable segment, a tab mounted upon said disk and connected intermediate its ends to said segment, said tab having a nose at one end and a handle at the other end, said nose and handle extending beyond the score at diametrically opposite areas.

10. A closure according to claim 9 together with means for releasably securing said handle against said disk.

11. The invention according to claim 10 and said releasable securing means comprising a flexible lip on said plastic insert overlapping the handle of the tab.

12. A container and closure assembly comprising a container having an open dispensing mouth defined by a peripheral wall, a groove in the interior of said peripheral wall extending entirely around said mouth, a closing disk seated in said groove, and said disk having a weakening line defining an opening panel in said disk, and manually operable tab means cooperating with said disk to break said disk along said weakening line for removal of said opening panel and providing access to the interior of said container.

13. A container and closure assembly according to claim 12 wherein said peripheral wall is an integral part of a body of said container.

14. A container and closure assembly according to claim 13 together with an overcap having a releasable interlock with said peripheral wall and overlying said disk.

15. A container and closure assembly according to claim 12 together with an overcap having a releasable interlock with said peripheral wall and overlying said disk.

16. A container and closure assembly according to claim 12 wherein said container includes an open mouth, and said peripheral wall is formed separately from said container body and is secured thereto.

* * * * *